United States Patent [19]

Hishinuma et al.

[11] Patent Number: 4,915,592

[45] Date of Patent: Apr. 10, 1990

[54] INNER-CAM TYPE DISTRIBUTION FUEL INJECTION PUMP

[75] Inventors: Osamu Hishinuma, Kariya; Fumiaki Tanaka, Obu; Akira Shibata, Anjo; Nobuo Kato, Toyohashi; Yutaka Inoue; Yukinori Miyata, both of Kariya, all of Japan

[73] Assignee: Nippondenso Co., Ltd., Kariya, Japan

[21] Appl. No.: 230,253

[22] Filed: Aug. 9, 1988

[30] Foreign Application Priority Data

| | | | |
|---|---|---|---|
| Aug. 10, 1987 | [JP] | Japan | 62-200306 |
| Oct. 9, 1987 | [JP] | Japan | 62-255637 |
| Nov. 18, 1987 | [JP] | Japan | 62-291499 |

[51] Int. Cl.[4] ..... F04M 1/10

[52] U.S. Cl. ..... 417/206; 417/462

[58] Field of Search ..... 417/206, 462

[56] References Cited

U.S. PATENT DOCUMENTS

| | | | |
|---|---|---|---|
| 3,161,138 | 12/1964 | Koster | 417/462 |
| 3,498,226 | 3/1970 | Mowbray | 417/206 X |
| 3,936,232 | 2/1976 | Mowbray | 417/206 |
| 4,046,494 | 9/1977 | Salzgeber et al. | 417/462 X |
| 4,200,072 | 4/1980 | Bailey | 417/462 X |
| 4,725,209 | 2/1988 | Shibata et al. . | |

FOREIGN PATENT DOCUMENTS

| | | |
|---|---|---|
| 61-96168 | 5/1986 | Japan . |

*Primary Examiner*—Leonard E. Smith

*Attorney, Agent, or Firm*—Cushman, Darby & Cushman

[57] ABSTRACT

An inner-cam type distribution fuel injection pump has a lubricating system for lubricating the interior of a cam chamber defined by an inner cam and a rotor with a lubricating oil having a viscosity higher than the viscosity of fuel oil. The pump is structured to prevent the fuel oil from leaking into the lubricating oil.

18 Claims, 6 Drawing Sheets

INNER-CAM TYPE DISTRIBUTION FUEL INJECTION PUMP

BACKGROUND OF THE INVENTION

1. Field of the Invention

The present invention relates to an inner-cam type distribution fuel injection pump and, more particularly, to an inner-cam type distribution fuel injection pump actuated by an inner cam having an inner peripheral cam profile, wherein lubricating condition is improved in a cam chamber which is formed by the inner cam and a rotor rotatable in the inner cam.

2. Description of the Prior Art

Fuel economy is a current social need which has given rise to the demand for fuel injection pumps capable of injecting fuel at higher levels of pressures. To cope with this demand, in the fields of distribution type fuel injection pump for diesel engines, a pump actuating mechanism has been proposed which employs an inner cam which has an inner peripheral cam surface in place of ordinary face cam having an outer peripheral cam surface. An example of this type of fuel injection pump actuating mechanism is disclosed in Japanese Patent Unexamined Publication No. 61-96168 entitled DISTRIBUTION-TYPE FUEL INJECTION PUMP ACTUATED BY INNER CAM. This type of fuel injection pump has a rotor having a radial bore which slidably receives a plunger. As the rotor rotates, the plunger is driven by the cam profile on the inner peripheral surface of the cam so as to reciprocatingly move within the radial bore thereby sucking, pressurizing and injecting fuel. In general, the rotor can have a plurality of such radial bores and plungers so that this type of fuel injector is suitable for attaining a high fuel injection pressure. Recently, attempts have been made to use a composite fuel composed of kerosene and alcohol, instead of light oil which has been conventionally used as a diesel engine fuel oil. Obviously, a higher fuel injection pressure requires the fuel injection pump to work under severer conditions and, hence, improved durability of fuel injection pump is becoming a critical demand. More specifically, the increased fuel injection pressure of the fuel injection pump actuated by an inner cam naturally increases the pressure at which the plungers are urged against the cam profile of the inner cam, resulting in a significant increase in the load applied to the inner cam, rollers which are held in sliding contact with the inner cam and roller shoes which rotatably carry the rollers. In conventional fuel injection pumps of the type described, the lubrication in cam chamber accommodating these sliding parts has relied solely upon the fuel. Such a lubricating method, however, cannot provide a required lubricating effect particularly when the pump operates under a heavy load, i.e., at a high injection pressure. Thus, wear of the sliding parts tend to grow rapidly due to inferior lubricating condition, causing unfavorable effect on the pump characteristic and durability of the pump.

SUMMARY OF THE INVENTION

Accordingly, an object of the present invention is to provide an inner-cam type distribution fuel injection pump wherein the interior of the cam chamber accommodating the inner cam and the rotor is lubricated with a lubricant having a higher viscosity than the fuel injected, thus providing a lubricating condition which good is enough to enable the fuel injection pump to operate under a heavy load.

According to one aspect of the present invention, there is provided an inner-cam type distribution fuel injection pump comprising: an inner cam having an inner peripheral cam profile; a rotor disposed in the inner cam and driven by a drive shaft so as to rotate relative to the inner cam; at least one plunger slidably received in a radial bore formed in the rotor, the plunger being capable of moving reciprocatingly in the radial bore as the radially outer end of the plunger slides on the cam profile on the inner cam thereby sucking, pressurizing and delivering a fuel oil; and a lubricating system for lubricating the interior of a cam chamber defined by the inner cam and the rotor with a lubricating oil having a viscosity higher than the viscosity of the fuel oil.

According to another aspect of the present invention, there is provided an inner-cam type distribution fuel injection pump comprising: an inner cam having an inner peripheral cam profile; a rotor disposed in the inner cam and driven by a drive shaft so as to rotate relative to the inner cam; at least one plunger slidably received in a radial bore formed in the rotor, the plunger being capable of moving reciprocatingly in the radial bore as the radially outer end of the plunger slides on the cam profile on the inner cam thereby sucking, pressurizing and delivering a fuel oil; a lubricating system for lubricating the interior of a cam chamber defined by the inner cam and the rotor with a lubricating oil having a viscosity higher than the viscosity of the fuel oil; an annular groove formed in one of the sliding surface of the plunger and the inner peripheral surface of the radial bore in the rotor; a low-pressure fuel passage communicating with the annular grooves; and a pressure control valve disposed in the low-pressure fuel passage or a lubricating oil passage leading to the cam chamber and operable so as to maintain the pressure in the low-pressure fuel passage at a level equal to or slightly higher than the pressure in the lubricating oil passage.

According to a still another aspect of the invention, there is provided an inner-cam type distribution fuel injection pump comprising: an inner cam having an inner peripheral cam profile; a rotor disposed in the inner cam and driven by a drive shaft so as to rotate relative to the inner cam; at least one plunger slidably received in a radial bore formed in the rotor, the plunger being capable of moving reciprocatingly in the radial bore as the radially outer end of the plunger slides on the cam profile on the inner cam thereby sucking, pressurizing and delivering a fuel oil; a lubricating system for lubricating the interior of a cam chamber defined by the inner cam and the rotor with a lubricating oil having a viscosity higher than the viscosity of the fuel oil; a pressure control valve for relieving the pressure of the sucked fuel to a low-pressure fuel passage leading to the low-pressure side of the fuel injection pump when the pressure of the sucked fuel has been increased beyond a predetermined level; an annular groove formed in one of the sliding surface of the plunger and the inner peripheral surface of the radial bore in the rotor and communicating with the low-pressure fuel passage downstream of the pressure control valve; and a check valve disposed in the low-pressure fuel passage and adapted to allow the fuel to flow only from the annular groove to the low-pressure fuel passage.

In operation, the rotor is driven by the drive shaft relative to the inner cam so that the plungers, which are received in an oil-tight manner in the radial bores formed in the rotor, reciprocatingly move within the radial bores as the outer ends of the plungers follow the cam profile on the inner peripheral surface of the cam as a result of rotation of the rotor, whereby the fuel is sucked, pressurized and injected. In addition, the interior of the cam chamber defined by the inner cam and the rotor is lubricated by a lubricating oil which has a viscosity higher than that of the fuel. The sliding parts such as the inner cam, rollers, roller shoes and plungers are, therefore, satisfactorily lubricated even when the pump works under a high pressure. This contributes to an improvement in the durability of the fuel injection pump and facilitates the use of composite fuels such as a mixture of kerosene and alcohol. In addition, the inner-cam type distribution fuel injection pump of the invention can be designed to prevent the lubricating oil in the cam chamber from coming into the fuel through the fuel collection passage, as is the case of the arrangement according to the second and third aspects of the invention, thus suppressing tendency for the fuel filters to clog.

Other objects, features and advantages of the present invention will become more apparent from the following description of the preferred embodiments with reference to the accompanying drawings.

DESCRIPTION OF THE PREFERRED EMBODIMENTS

The construction and operation of the fuel injection pump of the present invention will be fully understood from the following description of the preferred embodiments.

Figure 1:
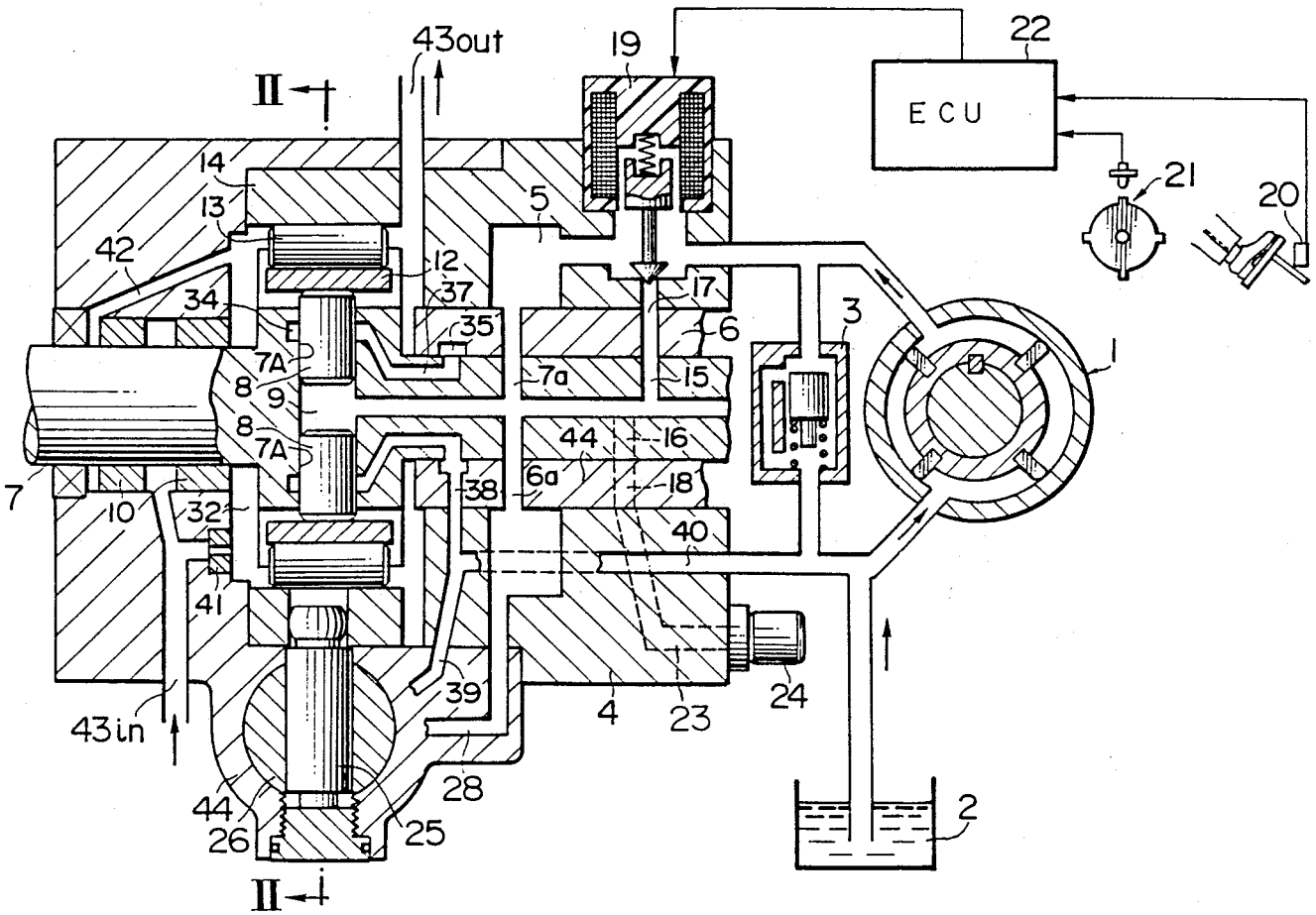
FIG. 1 is a schematic sectional view of a first embodiment of a inner-cam type distribution fuel injection pump in accordance with the present invention.
Figure 2:
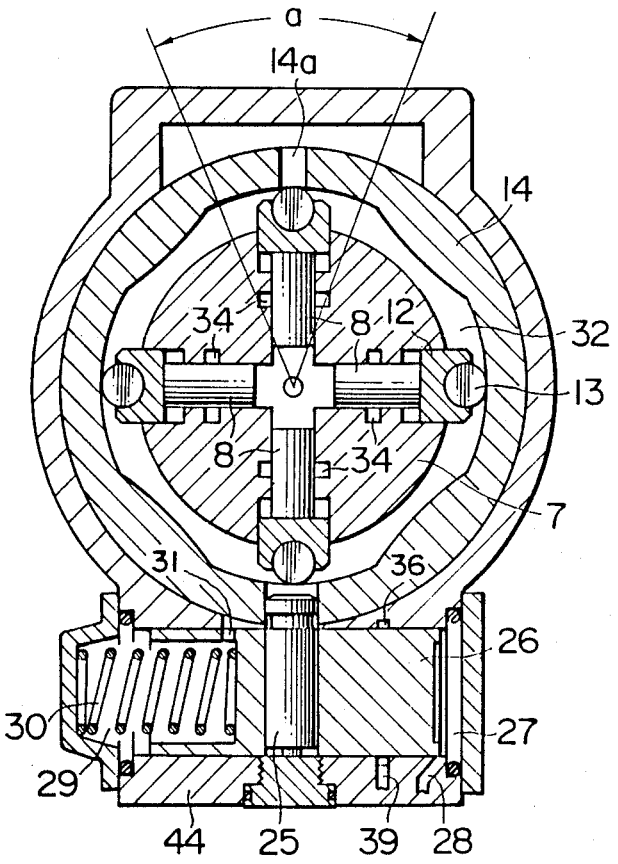
FIG. 2 is a sectional view taken along line II—II in FIG. 1.

FIG. 1 is a schematic sectional view of a first embodiment of the inner-cam type fuel injection pump designed for use in a diesel engine, while FIG. 2 is a sectional view taken along line II—II in FIG. 1.

As will be seen from these figures, this embodiment of the fuel injection pump is of solenoid-actuated spill control type and is provided with a feed pump 1. The construction of this fuel injection pump will be outlined with referenced to the flow of the fuel. The feed pump 1 is designed to suck the fuel up from a fuel tank 2 and the sucked fuel is supplied to a pressure control valve 3 which controls the fuel pressure. The fuel is then supplied into the gallery 5 within a head 4. The fuel in the gallery 5 is introduced into a plunger chamber 9 defined by plungers 8, through a passage **6*a* formed in a cylinder 6 and through a passage 7*a* formed in a rotor 7. The rotor 7 is received in the cylinder 6 for rotation in sliding contact therewith and is rotatably supported by bearings 10** so as to be driven by an engine which is not shown.

A plurality of radial cylindrical bores **7*a* are formed in the cylinder 7 and open in the outer peripheral surface of the cylinder 7. Each plunger 8 carries at its radially outer end a roller shoe 12 which in turn rotatably carries a roller 13. An inner cam 14 having a cam contour or profile on the inner peripheral surface thereof receives the rotors 13. Since the plunger is always urged radially outward by the pressure of the fuel, the roller 13 on the outer end of each plunger 8 is always held in contact with the cam profile of the inner cam 14. Therefore, as the rotor 7 rotates, the roller 13 on each plunger 8 rolls on the cam profile on the inner peripheral surface of the inner cam 14 so that the roller 13 performs a reciprocating motion in the radial direction. This movement of the roller 13 is transmitted to an associated plunger 8 through the roller shoe 12. When the plunger 8 moves radialy outwardly of the rotor 7, the volume of the space behind the plunger is increased to suck the fuel. Thus, the radially outward movement of the plunger 8 corresponds to the suction stroke of the pump. Conversely, a radially inward movement of the plunger 8 is performed by radially inward movement of the roller 13. The positional relationship between the passage 6*a* in the cylinder 6 and the passage 7*a* in the rotor 7 is so determined that the communication between both passages is established during a suction stroke in which the plunger moves towards the inner periphery of the inner cam 14 and is interrupted during a pressurizing stroke. The rotor 7 is further provided with a spill port 15 and a discharge port which communicates with the plunger chamber 9. These passages are brought into communication with passages 17 and 18 formed in the cylinder 6 during a discharge stroke of the plunger 8. Solenoid-actuated spill valve 19 is provided at the end of the passage 17 so as to selectively bring the passage 17 into communication with the gallery 5. The spill valve 19 is adapted to be driven by an electronic control unit (ECU) 22 in accordance with a signal indicative of the state of operation of the engine, e.g., a signal from throttle opening sensor 20 or a signal from a crank angle sensor 21. The passage 18 in the cylinder 6 is communicated with the delivery valve 24 through a passage 23** and further with an injection nozzle, i.e., a fuel injector, on the engine through a pipe not shown.

In operation, as the rotor 7 rotates by the power derived from the engine, each plunger 8 repeatedly conducts suction strokes in which it suckes fuel through the gallery 5 and the pressurizing strokes in which it pressurizes and delivers fuel to fuel injectors through the delivery valve 24. In synchronization with the stroking of the plungers 8, the solenoid-actuated spill valve 19 controls the timing of spill, i.e., the rate of fuel injection. The timing of fuel injection thus performed is adjustable by means of a timer. Namely, the inner cam 14 is connected to a timer piston 26 through a slide pin 25 so that it is rotationally displaced by the timer piston so that the phase of the cam is shifted to vary the timing of operation of the plungers and, hence, the timing of injection of the fuel.

As shown in FIG. 2, a pressure chamber 27 is formed on one end of the timer piston 26 and connected to the gallery through the passage 28. A low pressure chamber 29 is formed on the other end of the timer piston 26 and accommodates a spring 30 which urges the timer piston 26 towards the pressure chamber 27. The low-pressure chamber 29 is communicated through a communication hole 31 in the timer piston 26 with a cam chamber 32 accomodating the inner cam 14.

Therefore, the position of the timer piston 26 is determined by the balance between the forces acting on the timer piston 26 in the opposite directions, i.e., the force generated by the pressure in the pressure chamber 27 and the force which is the sum of the force produced by the spring 30 in the low-pressure chamber 29 and the force generated by the low pressure existing in the low-pressure chamber 29. The pressure chamber 27 of the timer is in communication with the gallery 5 and is adapted to receive the fuel the pressure of which has been regulated by the pressure control valve 3. The pressure determined by the pressure control valve 3 becomes higher as the engine speed increases, so that the timer piston 26 is progressively moved towards the low-pressure chamber 29 in accordance with the rise of the engine speed.

A description will be made hereinunder of the construction and operation for lubricating the sliding parts in the cam chamber 32.

Each plunger 8 is provided in the sliding surface thereof with an annular groove 34 which serves as a leak fuel collecting passage. Another annular groove 35 serving as a leak fuel collection passage is formed in a portion of the sliding surface of the cylinder 6 between the passage 7a and the cam chamber 32.

Furthermore, an annular groove 36 serving as a leak fuel collection groove is formed in a portion of the sliding surface of the timer piston 26 adjacent to the pressure chamber 27. These leak fuel collection grooves 34, 35 and 36 are connected to the fuel suction side of the fuel feed pump 1, i.e., to the low-pressure side of the fuel feed pump, through fuel passages 37, 38, 39 and 40.

The cam chamber 32 is lubricated in a manner explained below. The cam chamber 32 is supplied with a lubricating oil from a lubricating system of the engine (not shown) through an orifice 41. A part of the lubricating oil is introduced into the space between a pair of bearings 10 which support the rotor 7. The lubricating oil coming out of the gaps between the bearings 10 and the rotor 7 is introduced into the cam chamber 32 directly or indirectly through the passage 42. An oil outlet port 43 out is formed in an upper portion of the cam chamber 32 at the side of the inner cam 14 remote from the orifice 41. The lubricating oil, which is introduced through an oil inlet 43 in via the orifice 41 lubricates the inner cam 14, rollers 13 and the roller shoes 12 so as to lubricate and cool these members. The oil is then discharged through the oil outlet 43 out to the lubricating system of the engine which is not shown.

A high pressure is established in the plunger chamber 9 during an injection stroke. A part of pressurized fuel, therefore, leaks from the plunger chamber 9 into the cam chamber 32 through minute gaps between the plungers 8 and the rotor 7. Similarly, a part of fuel leaks into the cam chamber 32 through a minute gap between the rotor 7 and the cylinder 6. If the leaking fuel is allowed to flow into the cam chamber 32, the lubricating oil supplied into the cam chamber 32, which has a much higher viscosity than the fuel, is undesirably diluted and degraded. In the fuel injection pump of the described embodiment, however, the leaking fuel is caught in the leak fuel collection grooves 34 and 35 and does not flow beyond these collection grooves. Namely, since the leak fuel collection grooves 34 and 35 are communicated with the suction side of the feed pump 1, the pressure in these grooves 34 and 35 is almost the same as that in the cam chamber 32, so that no tendency exists for the fuel to flow from these grooves 34 and 35 into the cam chamber 32. It is thus possible to avoid undesirable dilution of the lubricating oil in the cam chamber 32 by the fuel.

The pressure in the timer pressure chamber 27, which is controlled by the pressure control valve 3 as explained before, is higher than the pressure in the cam chamber 32. In consequence, the fuel tends to leak from the timer pressure chamber 27 into the cam chamber 32 through a minute gap between the timer piston 26 and the wall of the housing 44. The annular groove 36 in the wall of the housing 44 effectively collects this leaking fuel so as to prevent this leaking fuel from reaching the cam chamber 32.

As will be understood from the foregoing description, it is possible to isolate the lubricating oil system from the fuel system almost completely by virtue of the annular grooves 34, 35 and 36, so that a good lubricating condition is always maintained in the cam chamber 32.

Figure 3:
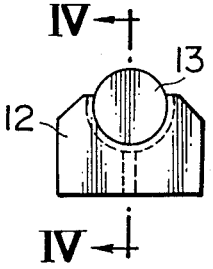
FIG. 3 is a side elevational view of a portion of the fuel injection pump showing particularly a roller and a roller shoe.
Figure 4:
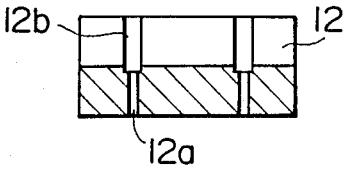
FIG. 4 is a sectional view taken along line IV—IV in FIG. 3.

The inner-cam type distribution fuel injection pump of the described embodiment is provided with an air vent hole 14a formed in a portion of the inner cam 14 near the top end of the inner can 14, as shown in FIG. 2. The position of the vent hole 14a may be freely selected within a region a (see FIG. 2) which is near the top end of the cam chamber 32 and which is devoid of crest of the cam contour. When a plunger has been rotated to this region a. the plunger 8 acting on the inner cam 14 receives the minimum load, so that no problem is caused in regard to the mechanical strength of the inner cam 14 and the roller 13 despite the presence of the vent hole 14a, even though the fuel injection pump is designed and constructed for a very high fuel injection pressure. As will be seen from FIGS. 3 and 4, a vent hole 12a and an air vent groove 12b are formed in the roller shoe 12 rotatably carrying the roller 13 which rolls on the cam profile of the inner cam 14 in contact therewith.

Trapping of air in the lubricating oil is inevitable because the lubricating oil has a viscosity which is much higher than that of the fuel oil. The vent hole 12a and the vent groove 12b formed in the roller shoe 12 effectively relieve the air trapped by the lubricating oil to the spacer in the upper portion of the cam chamber 32. Namely, air trapped by the lubricating oil and introduced into the roller shoe 12 is allowed to escape upwards through the air vent groove 12b so that the lubricating oil is continuously supplied into the area of sliding contact between the roller shoe 12 and the roller 13 through the communication hole 12a. This arrangement ensures that the roller can be adequately lubricated without any risk of cavitation. The air introduced into the cam chamber 32 is collected in the upper portion of the cam chamber 32 and is discharged through the vent hole 14*a* formed in the upper portion of the inner cam. The air is then relieved to the oil outlet 43 out. Therefore, any tendency for the roller 13 and the roller shoe 12 to trap air each time they pass the upper portion of the cam chamber 32 is eliminated to ensure good lubrication of the sliding surfaces of the roller 13 and the roller shoe 12.

In the illustrated embodiment, although the inner cam 14 and the roller shoe 12 are both provided with vent hole or groove, the arrangement may be modified such that the vent hole or the vent groove is provided only in one of the inner cam 14 and the roller shoe 12.

In the described embodiment, in order to ensure lubrication of all the portions of the cam chamber 32, the oil inlet port 43 in and the oil outlet port 43 out are disposed on the diametrically opposite sides of the inner cam 14. This means that a steady flow of lubricating oil is maintained across the inner cam 14 so that the inner cam 14 is effectively lubricated and cooled by fresh lubricating oil.

Lubrication is ensured also in the gaps between the bearings 10 and the rotor 7 by virtue of the oil introduction hole which is provided between the pair of bearings 10. Thus, the bearings 10 can support the rotor 7 in improved lubricating condition.

A description will be made hereinunder of another example of the timer with specific reference to FIG. 5. The timer shown in this figure employs a different arrangement for introducing the pressure medium into the pressure chamber 27 and the low-pressure chamber 29.

In the timer described before, the fuel and lubricating oil are introduced into the pressure chamber 27 and the low-pressure chamber 29, respectively. Since the position of the timer piston 26 is controlled mainly by change in the pressure in the pressure chamber 27, a good response of the timer is obtained by introducing the fuel oil into the pressure chamber 27 because the fuel oil is less viscous and, hence, exhibits a higher controllability than the lubricating oil. In addition, since the pressure of the fuel oil is controlled by the pressure control valve 5 before it is introduced into the pressure chamber through the gallery 5, the pressure in the pressure chamber 27 is always controlled in accordance with the pump speed. On the other hand, the introduction of the lubricating oil into the low-pressure chamber 29 can be conducted simply by providing a communication hole in the timer piston 26. This timer can operate satisfactorily when the ambient temperature is not so low. However, when the ambient air temperature is low as in the case of the use of the engine in a cold district or winter season, the viscosity of the lubricating oil is increased to pose a greater resistance to the sliding movement of the timer piston 26, with the result that the response of the timer is seriously impaired.

Figure 5:
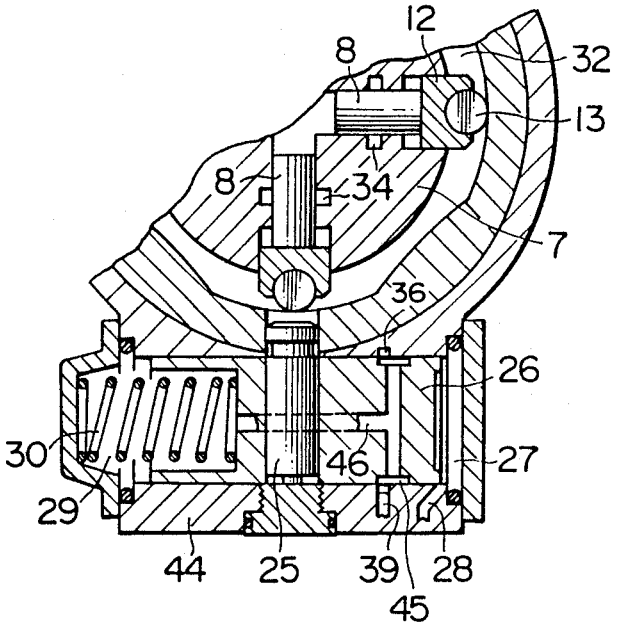
FIG. 5 is a sectional view of a different example of a timer.

In order to obviate this problem, the timer shown in FIG. 5 is designed such that the low-pressure chamber 29 also receives the fuel oil.

More specifically, in the timer shown in FIG. 5, the passage hole 31 used in the timer described before is eliminated so as to completely isolate the cam chamber 32 and the low-pressure chamber 29 from each other. In addition, an annular groove 45 is formed in the outer peripheral surface of the timer piston 26. The annular groove 45 communicates with the low-pressure chamber 29 through a passage 46. The low-pressure chamber 29 of the timer is therefore communicated with the suction side of the feed pump 1 through the passage 46, the annular groove 45, the annular groove 36 and the fuel passage 39, so that the fuel oil is introduced into the low-pressure chamber. Since the fuel oil generally exhibits only a small rise of viscosity when the temperature is lowered, as compared with lubricating oil, no substantial increase in the sliding resistance of the timer piston 26 is caused even when the air temperature is low, so that the timer can operate satisfactorily even when it is used at a low air temperature as in a cold district.

Although the described embodiment of the fuel injection pump has a lubricating system which makes use of the lubricating oil supplied from the lubricating system of the engine, the fuel injection pump of the invention may have a lubricating system which makes use of a lubricating oil stagnant in the cam chamber, independently from the engine lubricating system.

Figure 6:
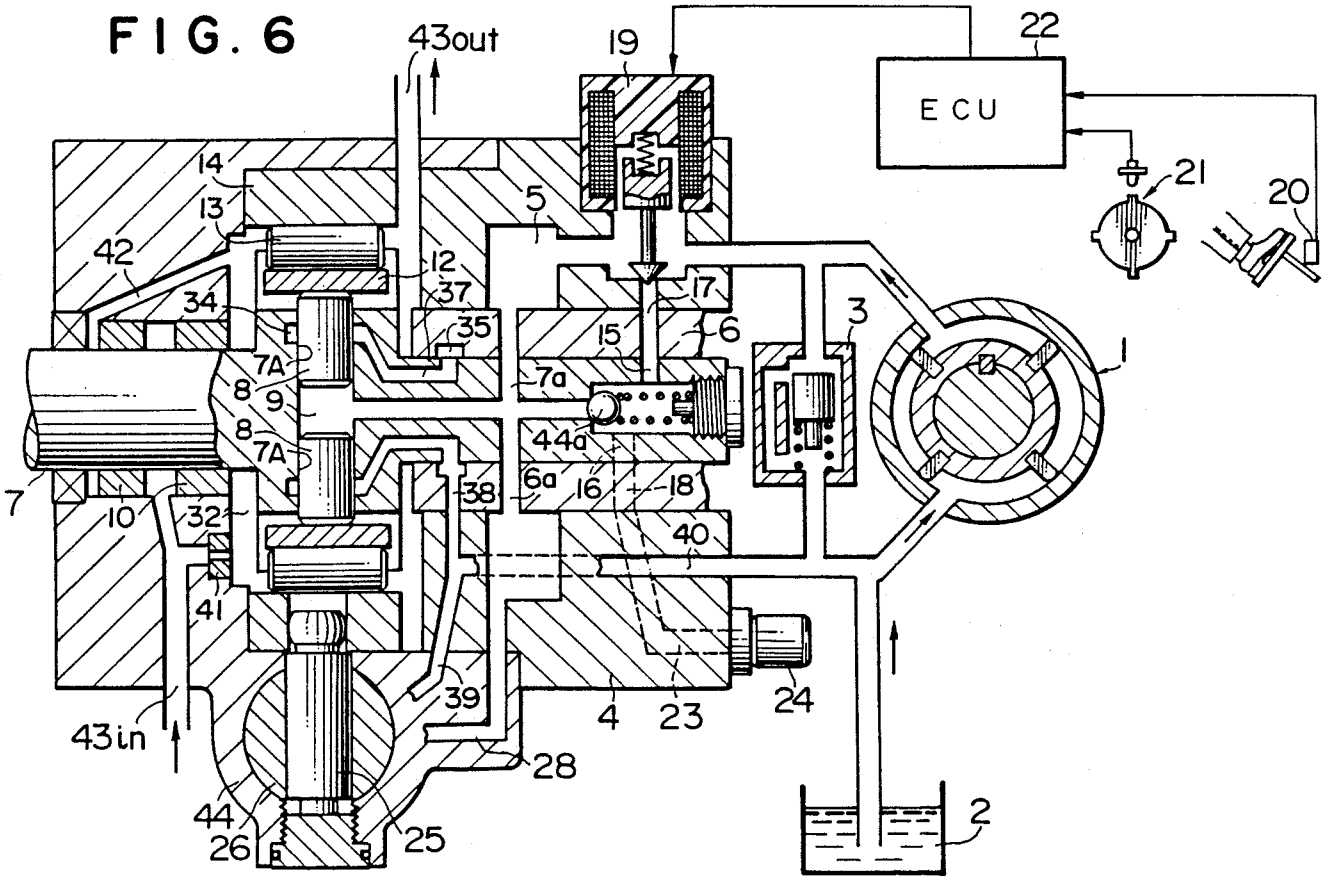
FIG. 6 is a schematic sectional view of a second embodiment of the inner-cam type distribution fuel injection pump in accordance with the present invention.

A second embodiment of the present invention will be described with specific reference to FIG. 6. In FIG. 6, the same reference numerals are used to denote parts or members which are the same as or equivalent to those shown in FIG. 1. Thus, such parts or members are not described to avoid duplication of explanation.

The second embodiment shown in FIG. 6 is distinguished from the first embodiment by the provision of a check valve 44*a*. The description of the second embodiment, therefore, will be focused on the features relating to the check valve 44*a*.

The check valve 44*a* is provided in the rotor 7. The injection pump has a suction port 7*a* disposed between the check valve 44*a* and the plunger chamber 9, while delivery ports 16 and a spill port 15 are provided on the downstream side of the check valve 44*a*. The check valve 44*a* is adapted to open the passage for the flow of fuel directed from the plunger chamber 19 to the discharge port 16, but closes the passage against reversing flow of the fuel.

The fuel is supplied to the plunger chamber 9 through the suction port 7*a* when the plunger is in its suction stroke, and is then pressurized in the subsequent delivery stroke, and is then pressurized in the subsequent delivery stroke, i.e., while the plunger 8 are moved inwards as they are pushed back by the cam profile of the inner cam 14. In consequence, the pressurized fuel opens the check valve 44*a* and reaches a delivery valve 24 through a delivery port 16 and passages 18 and 23. The fuel then forcibly opens the delivery valve 24 so as to be injected into an associated engine through a fuel injector which is not shown. During the fuel injection, the solenoid valve 19 is opened by the ECU 22 so that the fuel is returned to the delivery side of the feed pump 1 through the spill port 15, so that the fuel pressure drops to terminate the fuel injection. Thus, the amount or rate of fuel injection can be controlled by adjusting the timing of opening of the solenoid valve 19.

The pressure in the plunger chamber 9 drops due to spill of the fuel as a result of opening of the solenoid valve 19. However, since the check valve 44*a* is disposed between the plunger chamber 19 and the spill port 15, the fuel pressure in the plunger chamber 9 is maintained at a level which is higher than the spill pressure by an amount corresponding to the pressure required for forcibly opening the check valve 44*a*.

Meanwhile, the fuel pressure drops smoothly and rapidly in the delivery port 16 leading to the fuel injector on the engine, because the delivery port 16 is disposed downstream from the check valve 44*a*, whereby there fuel injection terminates quickly. Thus, the check valve 44a provides a double effect, i.e., prevention of jumping of the plunger 18 and prevention of drag of injection of fuel from the nozzle.

The jumping of the plunger is a phenomenon which tends to occur when the pressure in the plunger chamber is relieved during discharge. Namely, after the relief of the fuel pressure in the delivery stroke, only the centrifugal force acting on the masses of the plunger, roller and other associated component parts serve to urge the roller into contact with the cam profile of the inner cam so that negative acceleration, i.e., acceleration acting radially inwardly of the rotor, is increased to undesirably allow the roller to leave the cam profile. This phenomenon is known and generally referred to as jumping.

In order to obviate this problem, it is an effective measure to maintain a certain level of fuel oil pressure in the plunger chamber so that the plunger may be urged towards the inner cam by the force which is the sum of the above-mentioned centrifugal force and the force generated by the pressure differential across the plunger, i.e., the difference between the pressure in the plunger chamber and the pressure in the cam chamber. On the other hand, the engine requires that the fuel injection quickly terminates without any drag, from the view point of reduction in the amount of production of noxious exhaust gas components such as HC and CO. To this end, the pressure in the plunger chamber is preferably relieved to a level which is as low as possible. Thus, the relief of the pressure from the plunger chamber has to be conducted in such a manner as to meet both demands which are generally incompatible, i.e., prevention of jumping of the plunger and prevention of drag of the fuel after termination of the fuel injection. The second embodiment described in connection with FIG. 6 appreciably satisfies both demands by the provision of the check valve 44a.

Figure 7:
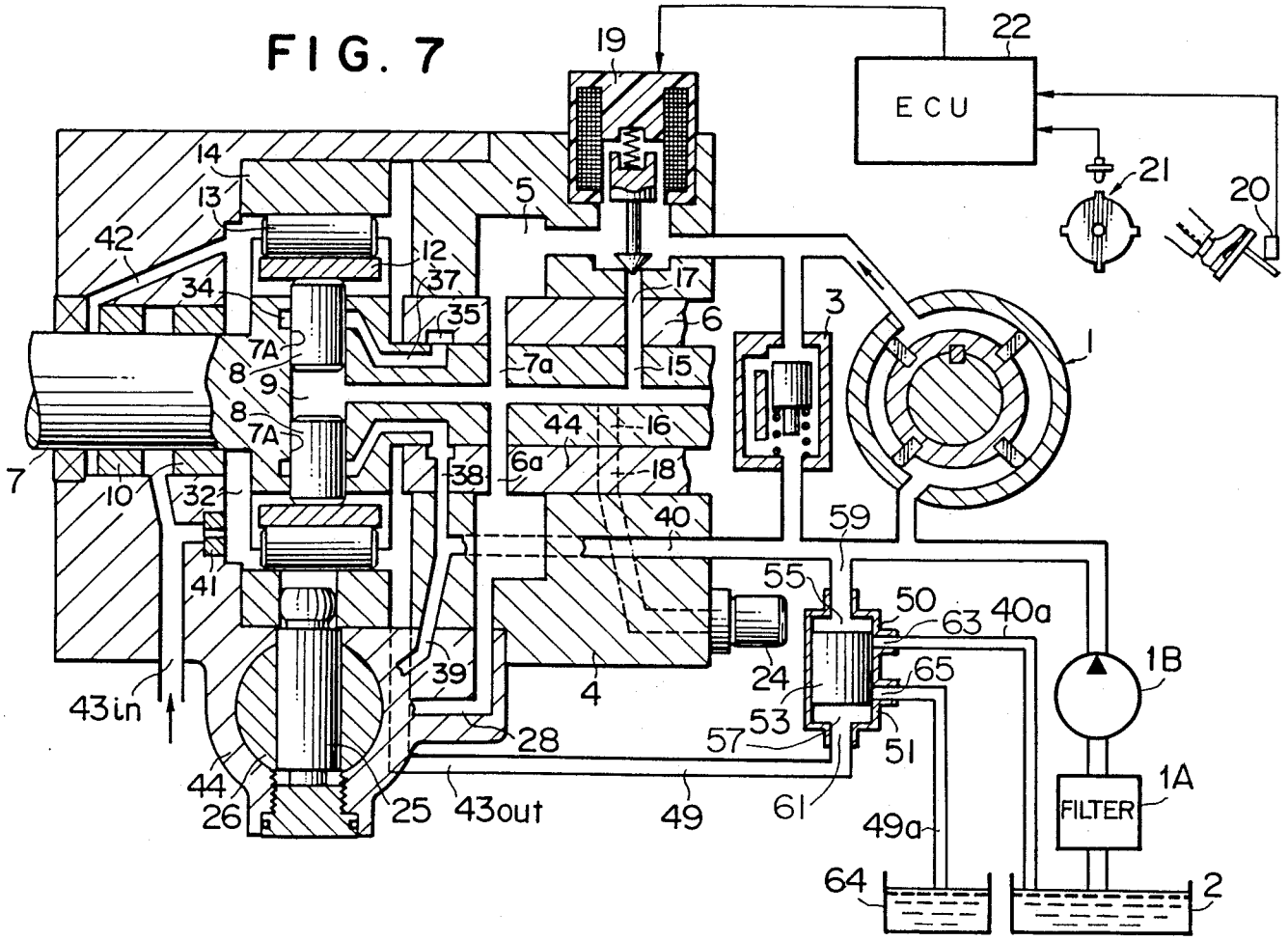
FIG. 7 is a schematic sectional view of a third embodiment of the inner-cam type distribution fuel injection pump in accordance with the present invention.

A third embodiment of the present invention will be described with reference to FIG. 7. In FIG. 7, parts or members which are the same as or equivalent to those used in the preceding embodiments are denoted by the same reference numerals. Detailed description of such parts or members is omitted.

The third embodiment shown in FIG. 7 is distinguished from the first embodiment shown in FIG. 1 in the following respects: Namely, a first point of difference resides in that the fuel suction line leading from the fuel tank 2 has a fuel filter 1A and a fuel booster pump 1B which can suck the fuel from the fuel tank 2 in such a manner as to compensate for a drop of the fuel pressure across the fuel filter 1A. A second point of the difference resides in that, in order to prevent the lubricating oil from mixing into the fuel, a pressure control valve 50 is provided between the fuel passage 40 and a lubricating oil passage 49 which leads to the lubricating oil outlet port 43 out. As shown in a greater scale in FIG. 8, the pressure control valve 50 has a main body 51 having a bore which slidably receives a spool 53. Liquid chambers 55 and 57 are defined on the respective ends of the spool 53. One 55 of these liquid chambers is communicated with the fuel passage 40 through a fuel port 59, while the other liquid chamber 57 communicates with the lubricating oil passage 49 through a lubricating oil port 61. A fuel discharge port 63 is formed in the side wall of the main part 51 of the pressure control valve 50 in communication with the fuel tank 2 through a fuel passage 40a. Similarly, a lubricating oil discharge port 65, which leads to an oil pan 64 through a lubricating oil passage 49a, is formed in the side wall of the main part 51 of the pressure control valve 50.

The operation of the pressure control valve 50 is as follows: When the levels of the pressure acting on both sides of the spool 53 are equal, the spool 53 is maintained at a neutral position as illustrated so that both the fuel discharge port 63 and the lubricating oil discharge port 65 are kept closed by the spool 53, whereby the cam chamber 32 and the fuel passage 40 are isolated from the ambient air.

Assuming that the pressure of the lubricating oil in the cam chamber 32 has risen to a level higher than the pressure of the fuel in the fuel passage 40, the spool 53 of the pressure control valve 50 is moved upwards as viewed in FIG. 7 so that the lubricating oil passage 49 is allowed to communicate with the lubricating oil discharge port 65 thereby establishing communication between the cam chamber 32 and the oil pan 64, whereby the lubricating oil in the cam chamber 32 is relieved to the oil pan 64 so as to lower the pressure in the cam chamber 32. In consequence, the pressure in the liquid chamber 57 comes down below the pressure of fuel in the liquid chamber 55, so that the spool 53 is moved downwards as viewed in the drawings. This operation of the spool 53 terminates when the levels of the pressure acting on both sides of the spool 53 are equalized, i.e., when the pressure of the lubricating oil in the cam chamber 32 has become equal to the pressure of the fuel in the fuel passage 40. In this state, the pressure in leak fuel collecting grooves such as the annular groove 36 becomes equal to the pressure in the cam chamber 32 so that any tendency for the lubricating oil to leak from the cam chamber 32 into the annular groove 36 through the minute gap between the piston pin 25 and the housing 44 is eliminated. In consequence, clogging of the fuel filter 1A which may otherwise be frequently caused by leakaged lubricating oil can be suppressed.

Figure 8:
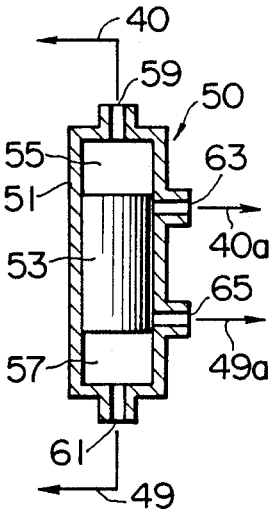
FIG. 8 is a sectional view of a pressure control valve incorporated in the third embodiment.
Figure 9:
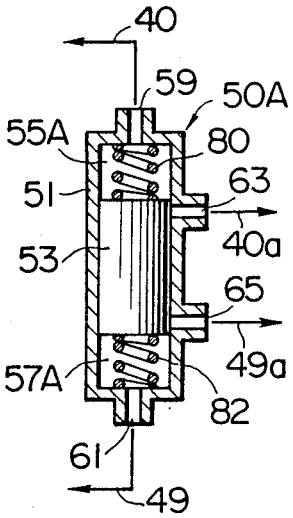
FIG. 9 is a sectional view of a modification of the pressure control valve.

FIG. 9 shows a modification 50A of the pressure control valve 50 of FIG. 8. In this modification, springs 80 and 82 having equal spring constants are disposed in both liquid chambers 55A and 57A so as to stabilize the movement of the spool 53.

The pressure control valve 50A may be further modified such that the spring 80 in the liquid chamber 55A communicating with the fuel passage is omitted, while the spring 82 in the other liquid chamber 57A is used. Such a modification can function in the same manner as a check valve which is incorporated in a fourth embodiment of the invention which will be described hereinunder. The same effect is obtainable by designing the pressure control valve such that the pressure receiving area of the spool facing the space leading to the fuel passage is smaller than the area of the other pressure receiving surface.

Figure 10:
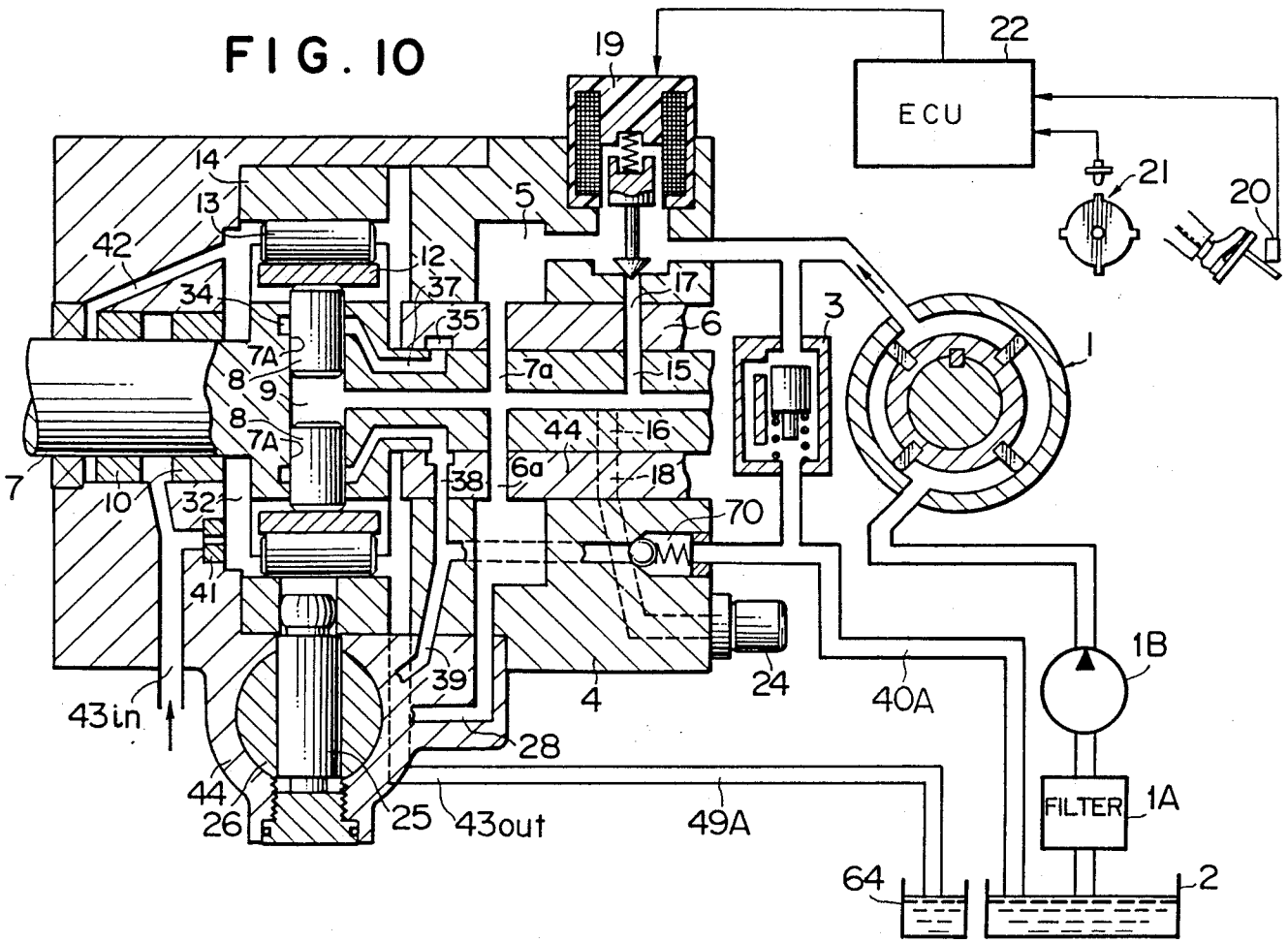
FIG. 10 is a schematic sectional view of a fourth embodiment of the inner-cam type fuel injection pump in accordance with the present invention.

A fourth embodiment of the present invention will be described hereinunder with specific reference to FIG. 10 in which the same reference numerals are also used to denote the same or equivalent parts and detailed description of such parts or members is omitted.

The fourth embodiment has a check valve 70 which is disposed in the fuel passage 40A for collecting the fuel and the fuel from this check valve 70 is returned to the fuel tank 2. On the other hand, the lubricating oil passage 49A for discharging lubricating oil from the cam chamber 32 is directly connected to the oil pan 64.

Since the fuel passage 40A and the lubricating oil passage 49A are both opened to the atmosphere, the pressure levels are substantially the same at the ends of these passages 40A and 49A are both opened to the atmosphere, the pressure levels are substantially the same at the ends of these passages 40A and 49A near the ends thereof open to the atmosphere. However, since the fuel passage 40A has the check valve 70 while the passage 49A is devoid of such a check valve, the pressure in the fuel collecting passage such as annular groove is higher than the pressure of the lubricating oil in the cam chamber 32 by an amount corresponding to the force which is required to open the check valve against a spring thereof, whereby leak of the lubricating oil into the fuel passage is prevented. When the pressure of the fuel supplied by the feed pump 1 into the gallery 5 has been increased to a level higher than a predetermined level, the pressure control valve 3 operates to return the fuel to the low-pressure side thereby lowering the fuel oil pressure to ordinary level.

The pressurized fuel is returned to the annular groove 34 through the passage 40A, the passage 38, the annular groove 35 and the fuel passage 37, so that the fuel pressure in the annular groove 34 is raised to a level higher than the level of the lubricating oil pressure in the cam chamber 32. This undesirably tends to allow the fuel to leak from the annular groove 34 into the cam chamber 32. In this embodiment, however, the leak of the fuel into the cam chamber 32 is prevented by the check valve 70 which blocks the passage for any flow of fluid from the annular groove 34 into the cam chamber 32. If the pressure set to open the check valve 70 is too high, the fuel pressure in the annular groove 34 may rise to an abnormally high level, resulting in leakage of fuel from the annular groove 34 into the cam chamber 32. From this point of view, it is necessary that the opening pressure of the check valve 70 is set at a very low level. for instance, in order to limit the rate of leak of the fuel from the annular groove 34 into the cam chamber 32 to the order of several cubic centimeters per hour, the opening pressure of the check valve 70 should be set at about 0.1 ata.

What is claimed is:

1. An inner-cam type distribution fuel injection pump comprising:

an inner cam having an inner peripheral cam profile;

a rotor disposed in said inner cam and driven by a drive shaft so as to rotate relative to said inner cam;

at least one plunger slidably received in a radial bore formed in said rotor, said plunger being capable of moving reciprocatingly in said radial bore as the radially outer end of said plunger slides on said cam profile on said inner cam thereby sucking, pressurizing and delivering a fuel oil; and a lubricating system for lubricating the interior of a cam chamber defined by said inner cam and said rotor with a lubricating oil having a viscosity higher than the viscosity of said fuel oil.

2. An inner-cam type distribution fuel injection pump according to claim 1, further comprising:

an annular groove formed in one of the sliding surface of said plunger and the peripheral surface of said radial bore in said rotor; and a low-pressure fuel passage communicating with said annular groove.

3. An inner-cam type distribution fuel injection pump according to claim 1, further comprising:

timer means disposed in a housing of said fuel injection pump and capable of rotationally displacing said inner cam.

4. An inner-cam type distribution fuel injection pump according to claim 3, wherein said timer means includes a timer piston slidably received in a bore formed in said housing, a slide pin through which the movement of said timer piston is transmitted to said inner cam, a timer pressure chamber formed on one end of said timer piston, and a low-pressure chamber formed on the other end of said timer piston and adapted to be supplied with a low-pressure fluid, said timer piston being actuated by a difference between forces produced in said timer pressure chamber and in said low-pressure chamber.

5. An inner-cam type distribution fuel injection pump according to claim 4, wherein said low-pressure chamber is supplied with a lubricating oil from said cam chamber while said timer pressure chamber receives the fuel oil of a high pressure determined by the speed of rotation of said drive shaft.

6. An inner-cam type distribution fuel injection pump according to claim 4, wherein a second annular groove is formed in the housing surface which is in sliding contact with said timer piston said annular groove being in communication with a fuel passage of a low pressure.

7. An inner-cam type distribution fuel injection pump according to claim 4, wherein said low-pressure chamber is supplied with fuel oil of a low pressure while said timer pressure chamber is supplied with fuel oil of a high pressure determined by the speed of rotation of said drive shaft.

8. An inner-cam type distribution fuel injection pump according to claim 1, wherein the quantity of injection of fuel by said fuel injection pump is controlled by causing the pressurized fuel in said pressure chamber to spill by the operation of a solenoid-actuated spill valve.

9. An inner-cam type distribution fuel injection pump comprising:

an inner cam having an inner peripheral cam profile;

a rotor disposed in said inner cam and driven by a drive shaft so as to rotate relative to said inner cam;

at least one plunger slidably received in a radial bore formed in said rotor, said plunger being capable of moving reciprocatingly in said radial bore as the radially outer end of said plunger slides on said cam profile on said inner cam thereby sucking, pressurizing and delivering a fuel oil;

a lubricating system for lubricating the interior of a cam chamber defined by said inner cam and said rotor with a lubricating oil having a viscosity higher than the viscosity of said fuel oil;

an annular groove formed in one of the sliding surface of said plunger and the dinner peripheral surface of said radial bore in said rotor;

a low-pressure fuel passage communicating with said annular groove; and a pressure control valve disposed in said low-pressure fuel passage or a lubricating oil passage leading to said cam chamber and operable so as to maintain the pressure in said low-pressure fuel passage at a level equal to or slightly higher than the pressure in said lubricating oil passage.

10. An inner-cam type distribution fuel injection pump according to claim 9, wherein said pressure control valve is a spool valve for interconnecting said fuel passage and a passage leading to said cam chamber and designed to equalize the levels of pressure in said fuel passage and said passage leading to said cam chamber.

11. An inner-cam type distribution fuel injection pump according to claim 9, wherein said pressure control valve is a check valve disposed in said fuel passage and adapted for allowing fuel oil to flow only to the low-pressure side of said fuel injection pump.

12. An inner-cam type distribution fuel injection pump according to claim 9, further comprising:

timer means disposed in a housing of said fuel injection pump and capable of rotationally displacing said inner cam.

13. An inner-cam type distribution fuel injection pump according to claim 12, wherein said timer means includes a timer piston slidably received in a bore formed in said housing, a slide pin through which the movement of said timer piston is transmitted to said inner cam, a timer pressure chamber formed on one end of said timer piston, and a low-pressure chamber formed on the other end of said timer piston and adapted to be supplied with a low-pressure fluid, said timer piston being actuated by a difference between the forces produced in said timer pressure chamber and in said low-pressure chamber.

14. An inner-cam type distribution fuel injection pump according to claim 13, wherein said low-pressure chamber is supplied with a lubricating oil from said cam chamber while said timer pressure chamber receives the fuel oil of a high pressure determined by the speed of rotation of said drive shaft.

15. An inner-cam type distribution fuel injection pump according to claim 14, wherein an annular groove is formed in the housing surface which is in sliding contact with said timer piston, said annular groove being in communication with a fuel passage of a low pressure.

16. An inner-cam type distribution fuel injection pump according to claim 13, wherein said low-pressure chamber is supplied with fuel oil of a low pressure while said timer pressure chamber is supplied with fuel oil of a high pressure determined by the speed of rotation of said drive shaft.

17. An inner-cam type distribution fuel injection pump according to claim 9, wherein the quantity of injection of fuel by said fuel injection pump is controlled by causing the pressurized fuel in said pressure chamber to spill by the operation of a solenoid-actuated spill valve.

18. An inner-cam type distribution fuel injection pump comprising:

an inner cam having an inner peripheral cam profile;

a rotor disposed in said inner cam and driven by a drive shaft so as to rotate relative to said inner cam;

at least one plunger slidably received in a radial bore formed in said rotor, said plunger being capable of moving reciprocatingly in said radial bore as the radially outer end of said plunger slides on said cam profile on said inner cam thereby sucking, pressurizing and delivering a fuel oil;

a lubricating system for lubricating the interior of a cam chamber defined by said inner cam and said rotor with a lubricating oil having a viscosity higher than the viscosity of said fuel oil;

a pressure control valve for relieving the pressure of the sucked fuel oil to a low-pressure fuel passage leading to the low-pressure side of said fuel injection pump when the pressure of the sucked fuel has been increased beyond a predetermined level;

an annular groove formed in one of the sliding surface of said plunger and the inner peripheral surface of said radial bore in said rotor and communicating with said low-pressure fuel passage downstream of said pressure control valve; and a check valve disposed in said low-pressure fuel passage and adapted to allow the fuel oil to flow only from said annular groove to said low-pressure fuel passage.

* * * * *